US007117552B2

(12) United States Patent
Hoffman

(10) Patent No.: US 7,117,552 B2
(45) Date of Patent: Oct. 10, 2006

(54) PORTABLE INFANT PLAYGROUND

(76) Inventor: Suzanne Hoffman, 669 Avocet, Arroyo Grande, CA (US) 93420

( * ) Notice: Subject to any disclaimer, the term of this patent is extended or adjusted under 35 U.S.C. 154(b) by 73 days.

(21) Appl. No.: 10/711,993

(22) Filed: Oct. 18, 2004

(65) Prior Publication Data

US 2006/0123540 A1 Jun. 15, 2006

Related U.S. Application Data

(60) Provisional application No. 60/512,511, filed on Oct. 18, 2003.

(51) Int. Cl.
*A47D 13/02* (2006.01)
*A47D 7/00* (2006.01)
*A47C 29/00* (2006.01)

(52) U.S. Cl. ..... 5/655; 5/414; 5/416; 446/227; 135/96; 135/136

(58) Field of Classification Search ..... 5/416, 5/97, 655, 414, 93.1, 94; 446/227; 135/136, 135/137, 124, 116, 120.1, 96; D6/596
See application file for complete search history.

(56) References Cited

U.S. PATENT DOCUMENTS

| | | | | | |
|---|---|---|---|---|---|
| 2,797,696 | A * | 7/1957 | Fritsche | 135/136 |
| 2,994,889 | A * | 8/1961 | Oblander | 5/499 |
| 3,855,643 | A * | 12/1974 | Sanford et al. | 4/498 |
| 4,043,349 | A * | 8/1977 | Gays et al. | 135/137 |
| D359,869 | S * | 7/1995 | Oren | D6/596 |
| D362,363 | S * | 9/1995 | Friedman | D6/596 |
| 5,660,002 | A * | 8/1997 | Lashinger | 52/63 |
| D408,192 | S * | 4/1999 | Chiang | D6/596 |
| 5,928,054 | A * | 7/1999 | Mast | 446/227 |
| 5,930,854 | A * | 8/1999 | O'Neill et al. | 5/655 |
| 5,971,761 | A * | 10/1999 | Tillman, Sr. | 434/81 |
| 7,037,170 | B1 * | 5/2006 | Pacella et al. | 446/268 |
| 2004/0266312 | A1 * | 12/2004 | Oren et al. | 446/227 |

* cited by examiner

*Primary Examiner*—Alexander Grosz
(74) *Attorney, Agent, or Firm*—Ken Tarbet

(57) ABSTRACT

This invention relates generally to infant activity centers, and more particularly to a portable infant playground.

13 Claims, 3 Drawing Sheets

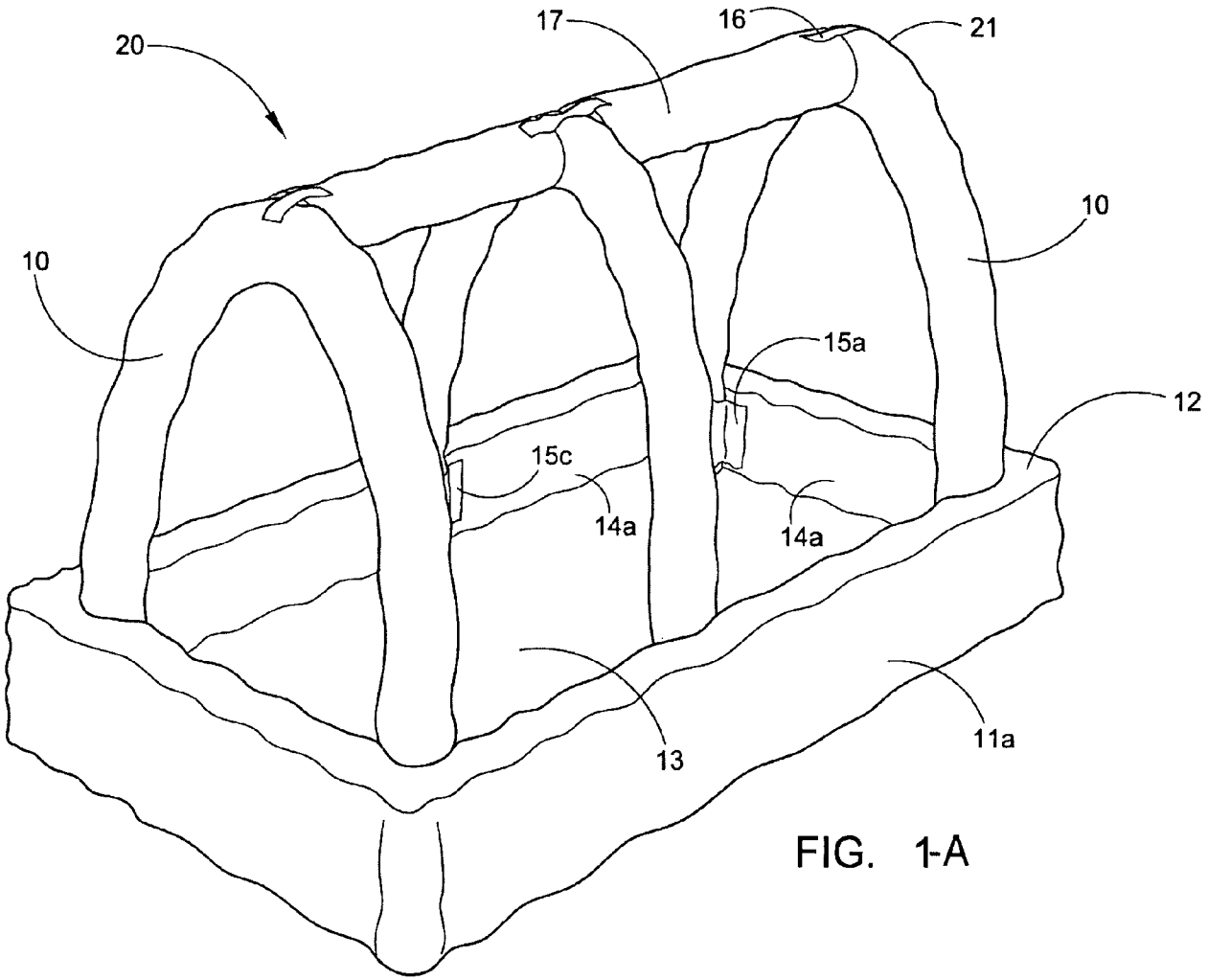
FIG. 1-A

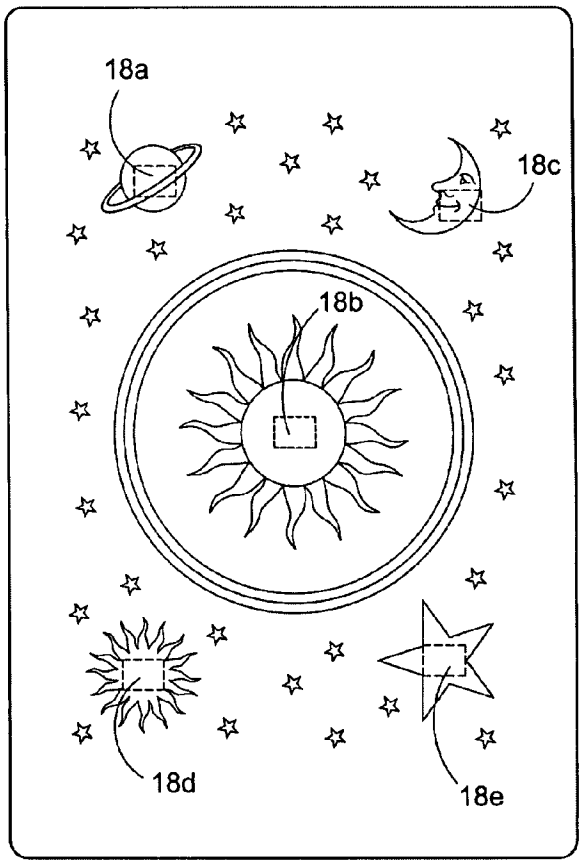
FIG. 1-C
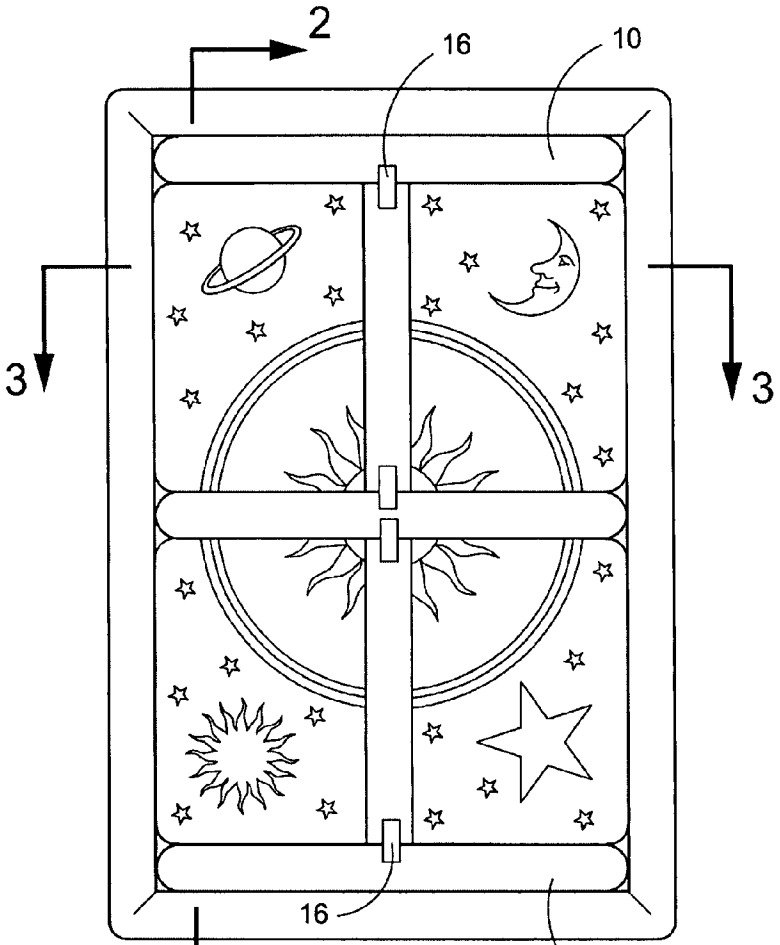
FIG. 1-B

PORTABLE INFANT PLAYGROUND

CROSS-REFERENCE TO RELATED APPLICATIONS

This application claims priority of the provisional application No. 60/512,511 filed Oct. 18, 2003, which is incorporated herein by reference.

STATEMENT REGARDING FEDERALLY SPONSORED RESEARCH OR DEVELOPMENT

This invention was not made through Federal funding.

BACKGROUND OF THE INVENTION

This invention relates generally to infant activity centers, and more particularly to a portable infant playground.

Activity centers provide infants with many developmental benefits. This is true even if an infant cannot physically interact with the activity center. In such cases, infants can receive audio and visual stimulation through various stimulation events that can be set in motion either manually or automatically. Additional visual stimulation are provided through proper selection of fabric, both along the cross pieces and the base and sides. Proper selection of additional items to hang from the cross members further adds to the infant's visual stimulation while in the playground. The present playground is designed so as to be placed either on the floor or any other safe and secure locations that provides both solid support underneath and which would not allow the infant to fall to the ground. The present invention does NOT propose to be a safety item that precludes it's improper placement, which improper placement, places the infant in danger.

As the infant develops, the infant will increase his (or her) physical interaction with the activity center. This physical interaction further encourages the development of physical attributes such as hand-eye coordination, range of motion, etc. Most conventional activity centers are designed to encourage interaction with the infant's hands. Here, effective activity-center designs enable infants to interact with the activity center with minimal directed hand coordination. More recent activity center designs have now begun to incorporate interactive elements that interact with an infant's feet. These types of activity centers require that the infant kick the event initiating means. The resultant events include visual and auditory events to further stimulate the infant. These infant activity centers provide an interaction that does not grow along with the child. Indeed, the activity centers of the art are of the "one size fits all" paradigm in which all children are assumed to be within a standard set of parameters, such as height. However, this limitation makes the activity center at the proper height for the child for a minimal period of time. These and other limitations of activity centers in the art are overcome by the portable playground of the present invention.

BRIEF SUMMARY OF THE INVENTION

A portable infant playground is disclosed that comprises:

a base member, a side member and optionally one or more rib members, where the base member may be geometric in shaped, or free-form shaped, may be constructed of any fabric and may be attached to a rigid base or my rely on the floor for rigid support, each wall member is either removeably or fixedly attached to the base member and may be constructed in a like manner to the base, or may be constructed in any other alternate form as desired, so long as the base members and the wall members combine to form an infant playground, substantially according to the figures and claims.

An additional aspect of the present invention relates to the rib members or arching rib members. These members are either fixedly or removeably attached to either the wall member and/or the base member. Each rib member may also be constructed of any suitable material. Each rib member may be of a rigid material which is covered by a softer material that is more conducive to child safety and comfort, e.g., radially pliable or compressible. Each rib member and/or each wall member may optionally have attachment sites whereat one could secure play items that also serve as stimulus items and/or items of enjoyment. These attachment sites are well known in the art and include hook and loop type. Of course these items may be any child play item as known in the art. The rib members may also be expandable such that the radius of curvature may be increased or decreased as desired and needed. The increase in this radius of curvature, increases the distance between the uppermost curve of the arch, the apex, and the base member, while simultaneously elongating the arch-rib into more of an ovoid shape. These rib members may optionally further include a means for securely fixing said rib members at a specific point along the elongation/minimization continuum.

The portable infant playground can be described in functional terms so as to more easily explain the invention. However, it should be understood, that the invention is not limited in any way to this functional description, but shall be limited only according to the attached claims. By this functional description, the inventor does not intend to devote any equivalent portions to the public, but rather intends to more easily describe that which the inventor claims as her invention.

The portable playground is formed from at least four major portions, any three of which can be used to form the infant playground of the present invention.

The first portion is the base member which can be formed of any fabric having any desired attribute, such as water resistance, stain resistance, washability or others. The base member may be of any shape, including geometric shapes such as rectangular and circular, but may be fabricated into any desired shape, even free-form shapes. The base member may further be made of a rigid material that is subsequently covered by a material of desired property, texture or construction The second portion is the wall members which have the same variability in construction as the floor or base member. Additionally, the wall members may be detachable from the floor member and may thereby form a playground without a base member, where the floor acts as the base. If desired, the playground may be constructed having only one or more wall members attached to the base member. In this way the playground can be physically manipulated and altered to exact desires and needs.

The third portion is the rib members that form an arching ceiling over the base member and provide additional visual stimulus as well as additional places to attach toys and other items for the child's enjoyment. Any number of rib members my be attached to either the floor member and/or the wall members, as desired without detracting from the invention but between 0 and 4 are preferred. The rib members may further be constructed to be longitudinally extendible, thereby also increasing the radius of curvature and the vertical height of the apex. Although not shown in the figures, this expansion property provides great expansion capabilities so that the playground can grow and increase in size according to the child's needs and/or parental desires. The rib members can be understood, functionally, as a tube within a tube. The smaller, inner tube slides within the outer tube. The outer tube defines the rib dimensions at it's shortest length and the sum of the length of the smaller tube and the larger tube define the maximum length. As further shown in the figure, a transverse rib member may also be used which may add some stability to the other rib members.

The arch-ribs may also attach at both ends to the same wall. In this configuration, one rib would arch from one corner to the other corner on the same wall.

The ribs may, furthermore, arch to be attached at either the inner surface or to the base/mat.

The ribs may furthermore, arch between opposite corners, forming an arched letter "X" over the base or mat.

Additional visual stimulation is provided through proper selection of fabric, both along the cross pieces and the base and sides. Proper selection of additional items to hang from the cross members further adds to the infant's visual stimulation while in the playground. The present playground is designed so as to be placed either on the floor or any other safe and secure locations that provides both solid support underneath and which would not allow the infant to fall to the ground. The present invention does NOT propose to be a safety item that precludes it's improper placement, which improper placement, places the infant in danger.

BRIEF DESCRIPTION OF THE SEVERAL VIEWS OF THE DRAWING

FIG. 1A is a perspective view of the inventive playground.

FIG. 1B is a top view of the inventive infant playground, depicting cutting lines 2 and 3 whereby

FIG. 1C is a bottom view of the inventive playground.

FIG. 2 is a cut-away view according to line 2 as shown in FIG. 1B.

FIG. 3 is a cut-away view along line 3 according to FIG. 1B.

DETAILED DESCRIPTION OF THE INVENTION

Figure 3:
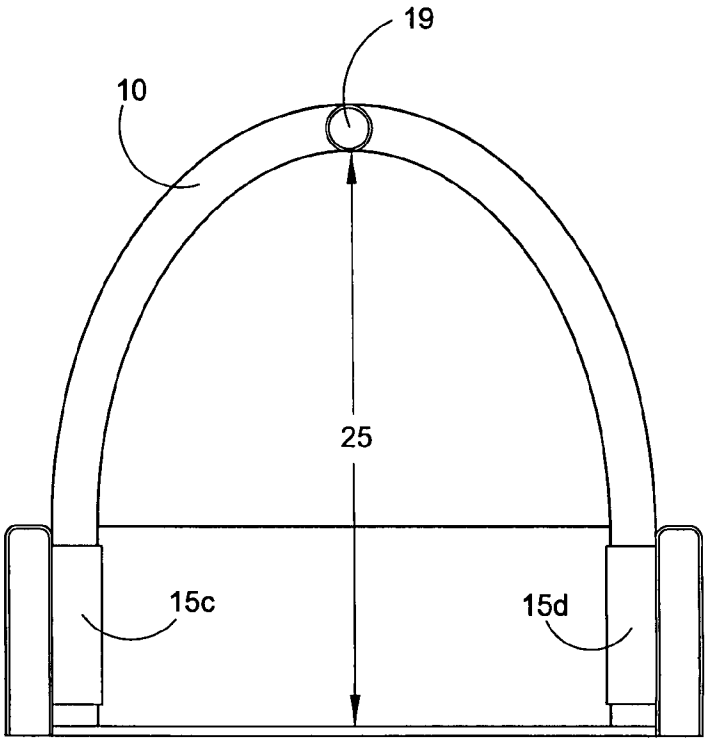
FIGS. 2 and 3 are defined.
Figure 2:
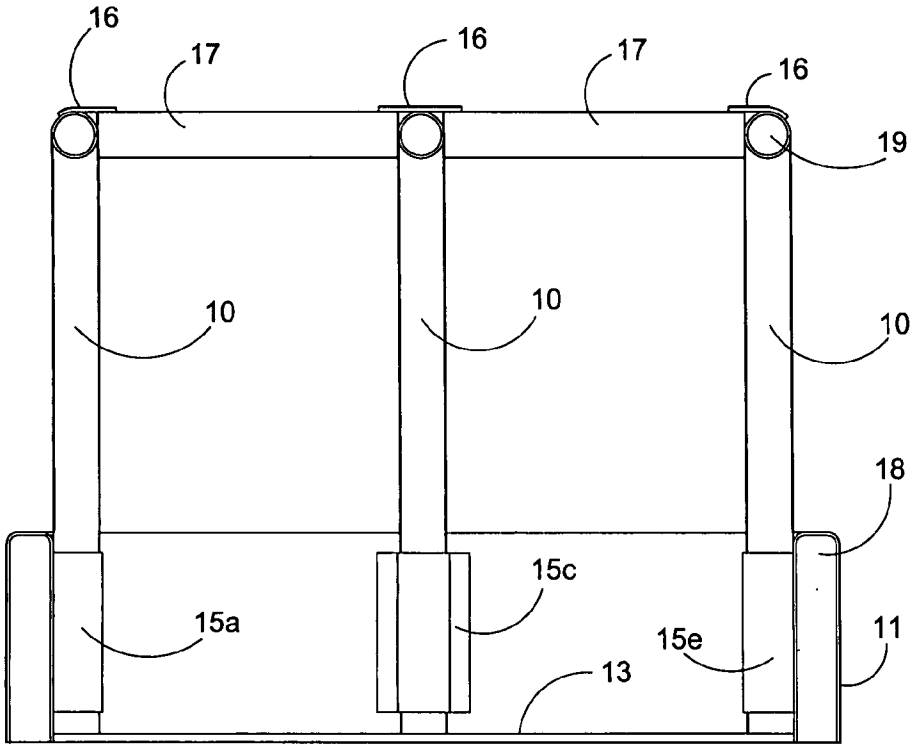

The infant playground 20 as shown in FIG. 1A is comprised of a base 13 of regular geometric shape, such as square or rectangular. Longitudinal walls having an outside 11, a thickness 12 and an inside surface 14*a* surround and are attached to the floor or matt or base 13 for the playground. Depending on the geometric shape used for the base 13, the vertically disposed walls will be of correspondingly different lengths. When the base 13 is patterned after a rectangle, as shown, then two walls are of equal length and longer than the other two, which are also equal to each other in length. The playground is depicted in FIG. 1A as a rectangle having two longer sides and two shorter sides. Elastic securing bands 15*a*–15*e* are securely adhered to the inner surfaces of the vertically disposed walls. Although not shown, it is equally acceptable for the elastic bands 15*a*–15*e* to be securely attached to any inner wall surface of any vertically disposed walls. Cylindrically shaped ribs 10 are elastically secured to the inner walls by the elastic securing means which is securely attached to the inner walls. These ribs 10 describe an arch in their path over the playground. A transverse rib 17 may be employed to add stability to the arch ribs 10. The transverse ribs 17 are removeably attached through attachment means 16, such as hook and loop or similar means as known in the art, to the arch ribs 10. The transverse ribs 17 are preferably attached at the apex 21 of the arch ribs 10. although they may be attached at any other position as desired.

Looking up from the underside of the base 13 of the playground presents the activation sites 18*a*–18*e*. These sites may optionally contain a pressure sensitive actuator attached to the base 13. According to one embodiment, these actuators are in electronic communication with an infant stimulation device associated with the playground. In this manner, when an infant actuates one or more of the actuators, the infant stimulation device is activated to provide one or more stimuli for the infant, such as audible, visual, tactile, or a combination of all three stimuli. Although the stimulation actuators are depicted to lie in the base 13 of the playground, it is to be understood that these actuators can be placed anywhere on or in the playground, according to desire. Indeed, additional stimuli actuators may be suspended from the arch ribs 10 or transverse ribs 17.

The vertically disposed walls are filled with a soft, pliable filling 18 suitable for infant contact, such as used in pillows, blankets and similar items.

Both the arch ribs 10 and the transverse ribs 17 are preferably cylindrically shaped having a core 19 of sturdy, strong yet flexible material, such as foam rubber, styrofoam or similar material. The ribs are optionally covered with a cloth like material, having a pattern suitable for infants. The playground is designed to be collapsed, for transportation and travel needs. The removal of the transverse ribs 17 allows the playground to be compressed, like an accordion, pushing the arch ribs 10 closer to each other, which likewise pushes two sides towards each other in a direction parallel the now removed transverse ribs 17. When compressed, the arch ribs 10 are in close proximity to each other, perhaps touching.

Although not shown, the arch ribs 10 can be oriented such that they do not arch over the playground, as currently shown, but arch more in parallel with one vertically disposed wall. The arch ribs 10 are elastically secured by securing means 15*a* and 15*e* on the same vertically disposed wall, describing an arch vertically above the wall, yet parallel thereto. In this orientation, the transverse ribs 17 connect the apex 21 of the arch rib 10 to another arch rib 10 across an alternate section of the base 13. Taking the orientation according to FIG. 1A, in the above described embodiment, the arch ribs would arch parallel and vertically above the longer wall of the rectangular base.

The embodiment of the figures is that of a rectangle, but other geometric shapes are envisioned, such as triangle, square, circle, pentagon, hexagon, etc. Although the figures depict three arch ribs 10 and two transverse ribs 17, the invention is not limited thereto and it is envisioned that numerous transverse and arch ribs may be employed, according to need and/or desire, typically between about 0 to 4 arch ribs and between about 0 to 8 transverse ribs are envisioned.

The present invention is directed to an infant playground comprising:

a base of regular geometric shape having a top-inner surface a bottom surface, side edges, vertically disposed walls and arch-ribs wherein;

the vertically disposed walls each correspondingly have an inner and outer surface;

an end of each arch-rib is removeably attached to the vertically disposed wall inner surface each arch-rib describes a semicircular path arching vertically to an apex; and where each vertically disposed wall is between about 0.5 inches to 10 inches tall and each arch-rib has an apex of curvature and further comprising a transverse rib having attachment means at each end, such as hook in loop type attachment means. The present infant playground has preferably between 0 and 6 ribs, including transverse ribs. The ribs are preferably cylindrical, but may be of any desired shape. The ribs are preferably soft and pliable or radially compressible, so as to be safe for children.

The present infant playground further has one or more than one event initiation, or activation spots on, in or under the playground. The means for event initiation may be a pressure sensitive device placed under the mat, whereby when the infant walks on the device, rolls over the device or in another way activates the device, one or more stimulatory events is caused. In a like manner the event initiation means may be within a wall, on the back or front side of a wall or on some portion of a rib. It is preferred that at least one event initiation means be part of the playground, but the playground may have any number of "hot spots", limited only by space within the playground and/or surface area on the playground. Although preferred, the means for event initiation may be moveably attached to any portion of the playground, the means may also be fixedly attached to the same place or a different place, according to desire.

The invention claimed is:

1. An infant playground comprising:

a base of regular geometric shape having a top-inner surface a bottom surface, side edges, vertically disposed walls and a plurality of integral, radially compressible arch-ribs wherein;

the vertically disposed walls each correspondingly have an inner and outer surface;

an end of each arch-rib is removeably attached to the vertically disposed wall inner surface each arch-rib describes a semicircular path arching vertically to an apex; where each vertically disposed wall is between about 0.5 inches to 10 inches tall and each arch-rib has an apex of curvature a plurality of transverse ribs are removably attached between the arch ribs, and separable fastener means adapted to removably attach the transverse ribs to the arch ribs.

2. The infant playground according to claim 1 wherein the transverse-rib are attached to the apex of the arch-ribs.

3. The infant playground according to claim 1 wherein the arch-ribs have a cylinder cross section shape.

4. The infant playground according to claim 1 wherein the transverse-ribs have a circular cross section.

5. The infant playground according to claim 1 wherein the base is removable.

6. The infant playground according to claim 1 wherein the arch-rib or the transverse-rib is elongateable.

7. An infant playground according to claim 1, further comprising:

means for an event initiation.

8. The infant playground according to claim 7 wherein the event initiation means is a pressure sensitive device.

9. The infant playground according to claim 8 wherein the pressure sensitive device initiates the event.

10. The infant playground according to claim 9 wherein the event is an audible event, a visual event, a combined audio and visual event or a tactile event.

11. The infant playground according to claim 7 wherein the event initiation means is moveably attached to the base.

12. The infant playground according to claim 7 wherein the event initiation means is moveably attached to the wall.

13. The infant playground according to claim 7 wherein the event initiation means is moveably attached to a rib.

* * * * *